US010413107B1

(12) United States Patent
Cohen

(10) Patent No.: US 10,413,107 B1
(45) Date of Patent: Sep. 17, 2019

(54) CHRISTMAS TREE DISPOSAL BAG

(71) Applicant: John Cohen, Toms River, NJ (US)

(72) Inventor: John Cohen, Toms River, NJ (US)

( * ) Notice: Subject to any disclaimer, the term of this patent is extended or adjusted under 35 U.S.C. 154(b) by 0 days.

(21) Appl. No.: 16/018,152

(22) Filed: Jun. 26, 2018

(51) Int. Cl.
*A47G 33/04* (2006.01)
*B65D 65/08* (2006.01)

(52) U.S. Cl.
CPC ..... *A47G 33/045* (2013.01); *B65D 65/08* (2013.01)

(58) Field of Classification Search
USPC ..... 206/423; 383/42, 105, 107, 119, 121
See application file for complete search history.

(56) References Cited

U.S. PATENT DOCUMENTS 1,378,607 A * 5/1921 Norton ..... A47L 13/502 15/104.001
2,781,811 A * 2/1957 Dilar ..... A47G 33/045 206/423
3,729,039 A * 4/1973 Walsh ..... A47G 33/045 206/423
4,384,604 A * 5/1983 DeLaura ..... A47G 33/045 206/423
4,799,520 A * 1/1989 Blackburn ..... A47G 33/045 206/423
4,899,878 A * 2/1990 Lofton ..... A47G 33/045 206/423
5,291,999 A 3/1994 Phair
5,746,317 A * 5/1998 Turner ..... A47G 33/045 206/423
D406,080 S 2/1999 Marr
7,334,941 B2 * 2/2008 Fenster ..... D06F 95/006 134/34
7,694,494 B2 * 4/2010 Bornemeier ..... A47G 33/045 53/389.2
10,251,504 B1 * 4/2019 Sutton ..... A47G 33/045
2003/0159958 A1 * 8/2003 Falk ..... A45F 3/02 206/423
2003/0226780 A1 * 12/2003 Brown ..... A47G 11/003 206/423
2004/0262183 A1 * 12/2004 Gildart ..... A45C 11/00 206/423
2005/0166448 A1 * 8/2005 Liu ..... A01G 13/0281 47/32

(Continued)

FOREIGN PATENT DOCUMENTS

GB 2447217 A 9/2008

*Primary Examiner* — Jacob K Ackun

(57) ABSTRACT

The Christmas tree disposal bag is configured for use with a Christmas tree. The Christmas tree disposal bag is configured for use as a tree skirt and as a containment structure. The Christmas tree disposal bag is disposable such that the Christmas tree disposal bag contains the Christmas tree and unwanted decorative items in a segregated fashion during disposal. The Christmas tree disposal bag comprises the containment structure, a plurality of compartments and a zipper. The containment structure is a hollow sheeting structure. The Christmas tree is stored within the hollow interior of the containment structure. The plurality of compartments comprises a plurality of pouches used to store decorative items intended for transport and storage with the Christmas tree. The zipper is a fastener that is intended to control access into the hollow interior of the containment structure.

15 Claims, 6 Drawing Sheets

(56) References Cited

U.S. PATENT DOCUMENTS

| | | | | |
|---|---|---|---|---|
| 2005/0183975 | A1* | 8/2005 | Stein | A47G 33/045 206/423 |
| 2005/0211589 | A1* | 9/2005 | Holzhaus, II | A47G 33/045 206/423 |
| 2007/0227925 | A1* | 10/2007 | Westrate | A47G 33/045 206/423 |
| 2007/0235962 | A1* | 10/2007 | Jamie | B62B 1/26 280/47.26 |
| 2008/0185307 | A1* | 8/2008 | Hecht | A47G 33/045 206/423 |
| 2008/0257770 | A1* | 10/2008 | Limber | B62B 1/26 206/423 |
| 2008/0308440 | A1* | 12/2008 | Bornemeier | A47G 33/045 206/423 |
| 2016/0324079 | A1* | 11/2016 | Belschner | B65D 85/52 |
| 2017/0232985 | A1* | 8/2017 | Hendricks | A45C 13/04 206/423 |
| 2017/0253405 | A1* | 9/2017 | Limber | A47G 33/06 |

* cited by examiner

CHRISTMAS TREE DISPOSAL BAG

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including hand carried bags, more specifically, a receptacle for a purpose not otherwise provided for.

SUMMARY OF INVENTION

The Christmas tree disposal bag is configured for use with a Christmas tree. The Christmas tree is further defined with decorative items. The Christmas tree disposal bag is configured for use as a tree skirt when the Christmas tree is on display. The Christmas tree disposal bag is configured for use as a containment structure that stores the Christmas tree when the Christmas tree is not in use. The Christmas tree disposal bag is disposable such that the Christmas tree disposal bag contains the Christmas tree and unwanted decorative items in a segregated fashion during disposal. The Christmas tree disposal bag comprises the containment structure, a plurality of compartments and a zipper. The containment structure is a hollow sheeting structure. The Christmas tree is stored within the hollow interior of the containment structure. The plurality of compartments comprises a plurality of pouches used to store decorative items intended for transport and storage with the Christmas tree. The plurality of storage compartments 102 may be integrated into the design of the containment structure 101 or a removable component of the invention 100. The zipper is a fastener that is intended to control access into the hollow interior of the containment structure.

These together with additional objects, features and advantages of the Christmas tree disposal bag will be readily apparent to those of ordinary skill in the art upon reading the following detailed description of the presently preferred, but nonetheless illustrative, embodiments when taken in conjunction with the accompanying drawings.

In this respect, before explaining the current embodiments of the Christmas tree disposal bag in detail, it is to be understood that the Christmas tree disposal bag is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the Christmas tree disposal bag.

It is therefore important that the claims be regarded as including such equivalent construction insofar as they do not depart from the spirit and scope of the Christmas tree disposal bag. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
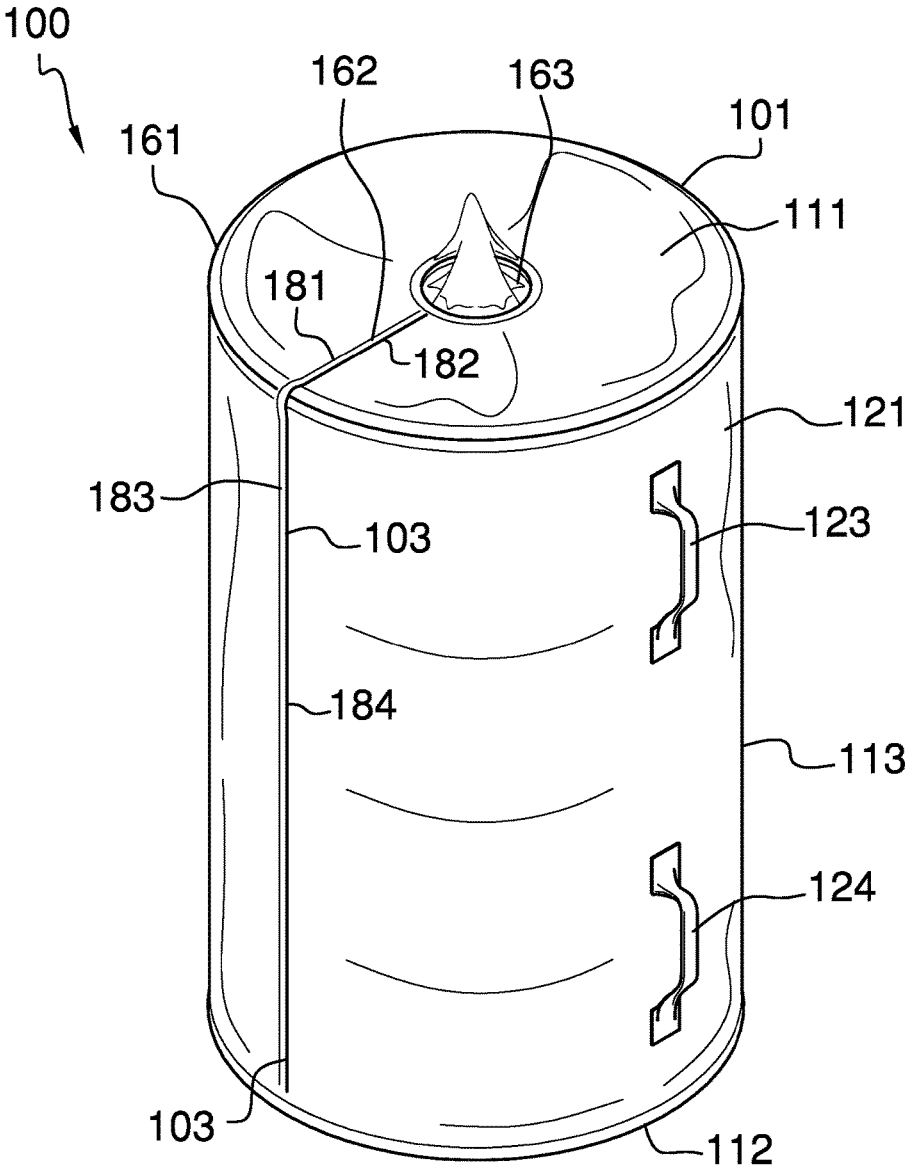
FIG. 1 is a perspective view of an embodiment of the disclosure.
Figure 2:
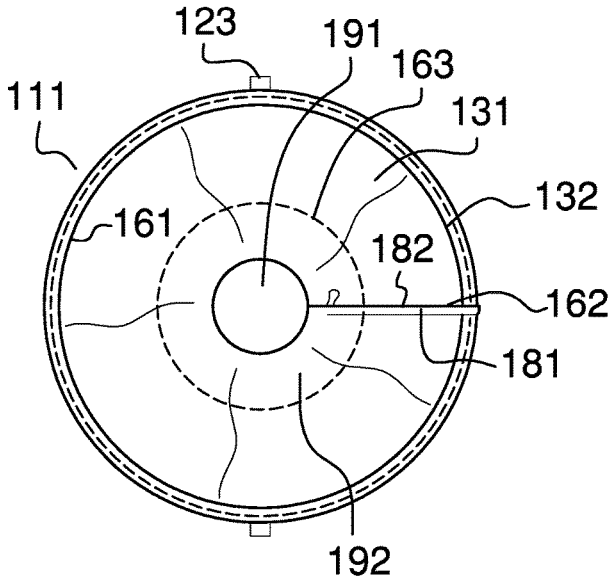
FIG. 2 is a top view of an embodiment of the disclosure.
Figure 3:
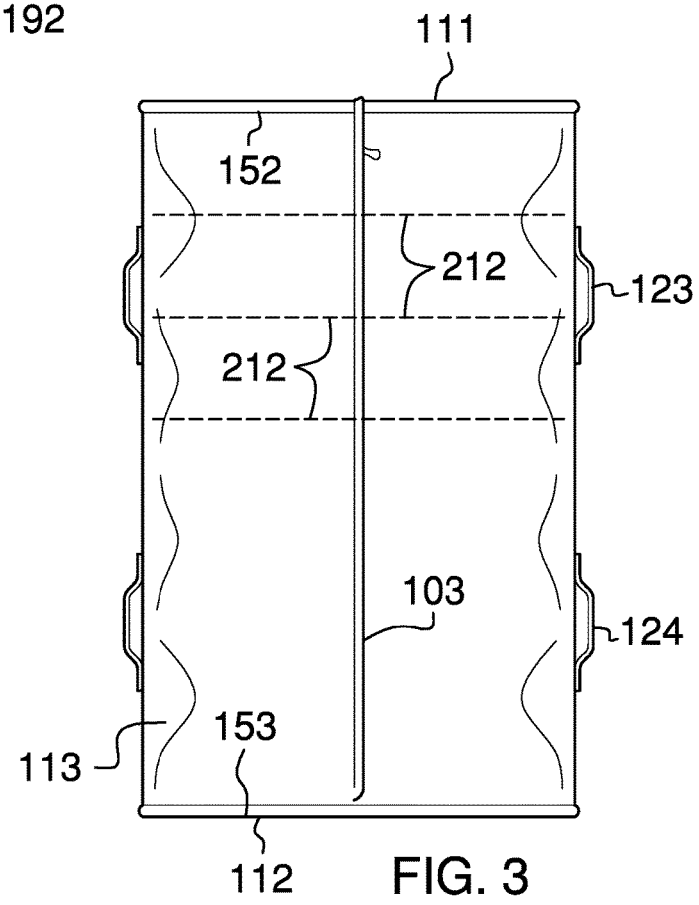
FIG. 3 is a front view of an embodiment of the disclosure.
Figure 4:
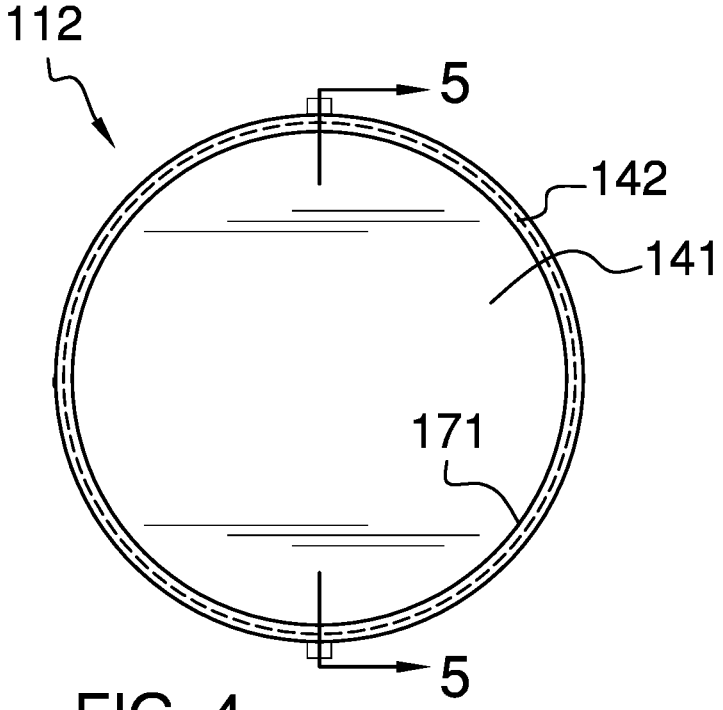
FIG. 4 is a bottom view of an embodiment of the disclosure.
Figure 5:
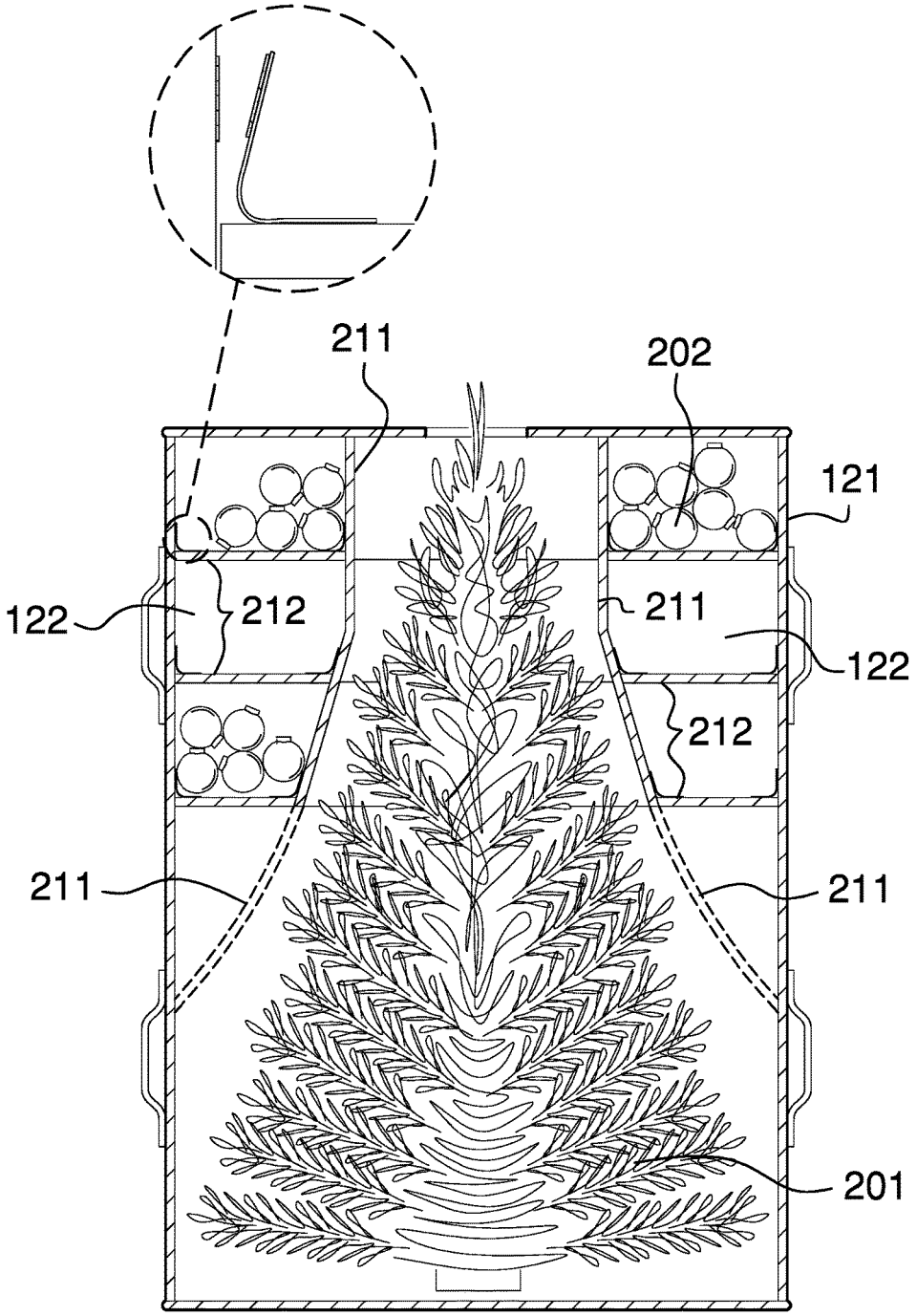
FIG. 5 is a cross-sectional view of an embodiment of the disclosure across 5-5 as shown in FIG. 4.
Figure 5A:
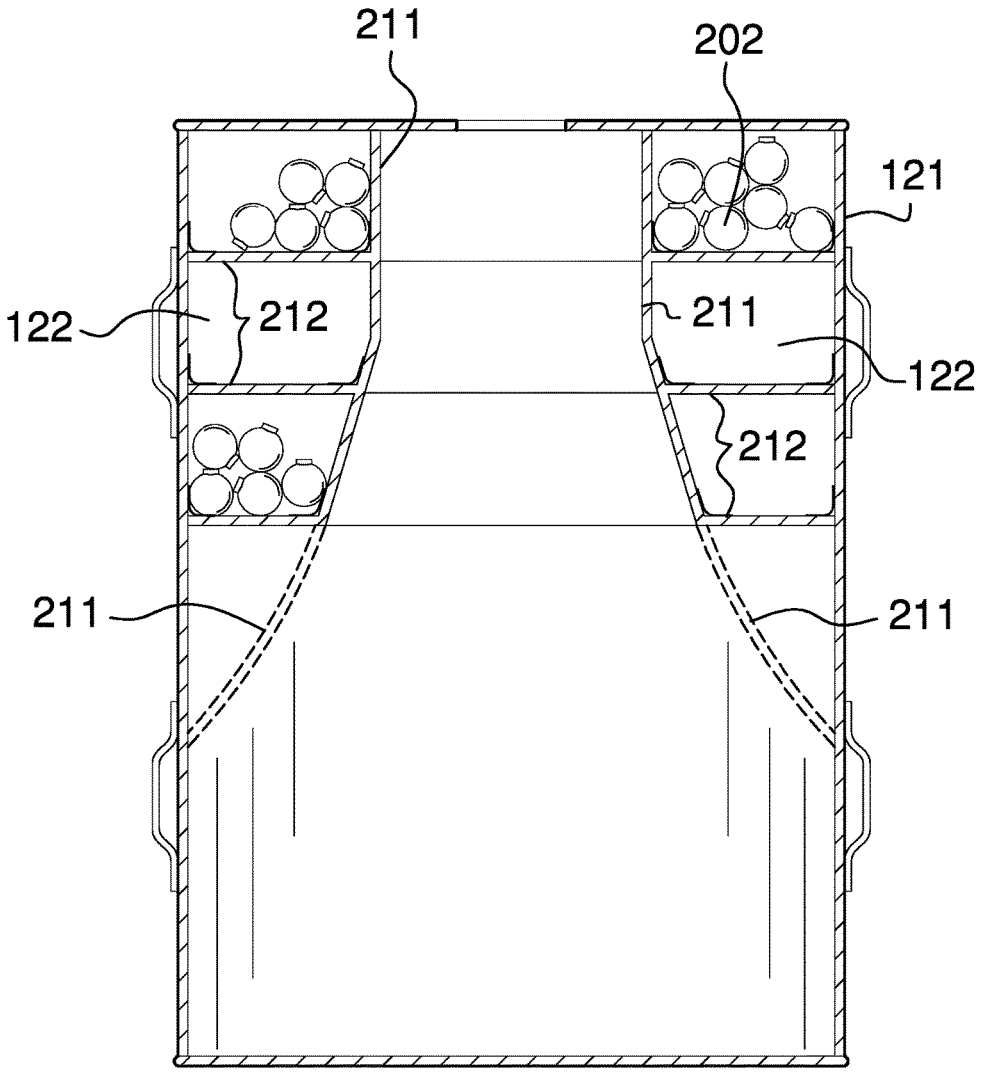
FIG. 5A is another cross-sectional view of an embodiment of the disclosure across 5-5, but with the Christmas tree removed.
Figure 6:
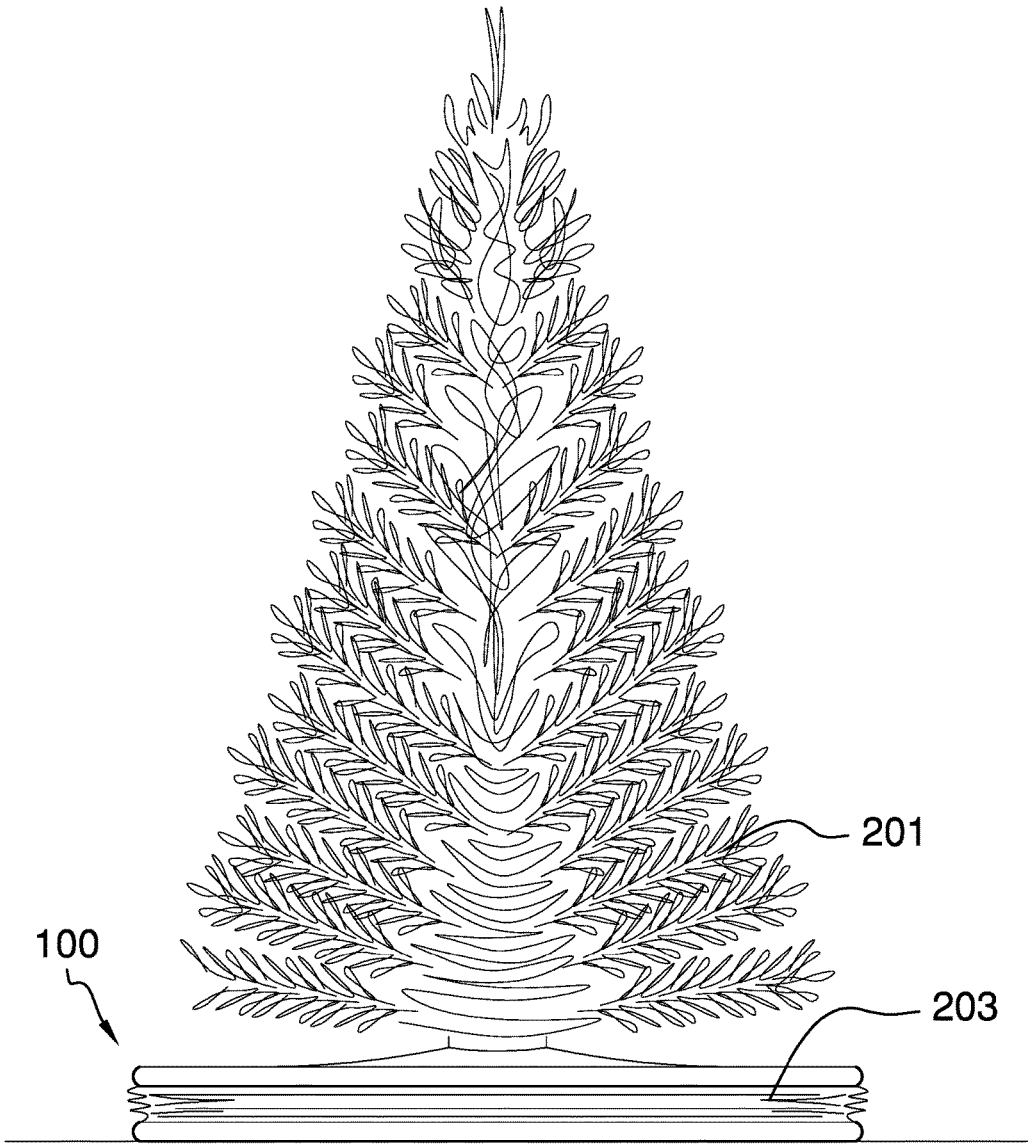
FIG. 6 is an in-use view of an embodiment of the disclosure.

Detailed reference will now be made to one or more potential embodiments of the disclosure, which are illustrated in FIGS. 1 through 6.

The Christmas tree disposal bag 100 (hereinafter invention) is configured for use with a Christmas tree 201. The Christmas tree 201 is further defined with decorative items 202. The invention 100 is configured for use as a tree skirt 203 when the Christmas tree 201 is on display. The invention 100 is configured for use as a containment structure 101 that stores the Christmas tree 201 when the Christmas tree 201 is not in use. The invention 100 is either disposable or reusable such that the invention 100 contains the Christmas tree 201 and unwanted decorative items 202 in a segregated fashion during non-use. The invention 100 comprises the containment structure 101, a plurality of storage compartments 102 and a zipper 103. The containment structure 101 is a hollow sheeting structure. The Christmas tree 201 is stored within the hollow interior of the containment structure 101.

The plurality of storage compartments 102 comprises a plurality of pouches used to store decorative items 202 intended for transport and storage with the Christmas tree 201. The plurality of storage compartments 102 may be integrated into the design of the containment structure 101 or a removable component of the invention 100. The zipper 103 is a fastener that is intended to control access into the hollow interior of the containment structure 101.

The zipper 103 is a fastening device. The zipper 103 fastens a first edge of a first sheeting to a second edge of a sheeting selected from the group consisting of the first sheeting and a second sheeting. The zipper 103 is defined in greater detail elsewhere in this disclosure. The zipper 103 is a well-known and documented fastening device.

The containment structure 101 is a hollow cylindrical structure. The containment structure 101 is sized to receive the Christmas tree 201 during periods of transport and/or storage. The containment structure 101 is formed with no vertical supports. The containment structure 101 is vertically supported by the Christmas tree 201 when the Christmas tree 201 is stored in the containment structure 101. The containment structure 101 collapses when the Christmas tree 201 is removed from the containment structure 101. The containment structure 101 collapses such that the containment structure 101 forms a tree skirt 203 around the Christmas tree 201 during the display of the Christmas tree 201. The containment structure 101 comprises a superior end 111, an inferior end 112, and a lateral face 113.

The superior end 111 refers to a circular end of the hollow cylindrical structure that forms the containment structure 101. The superior end 111 is the end of the containment structure 101 that collapses towards the supporting surface when the containment structure 101 is removed from the Christmas tree 201 to form the tree skirt 203. The superior end 111 is distal from the inferior end 112 of the containment structure 101. The superior end 111 comprises a superior sheeting 131 and a first split ring 132.

The superior sheeting 131 is formed from a textile. The superior sheeting 131 has a circular shape. The superior sheeting 131 forms the surface of the superior end 111 of the cylindrical structure of the containment structure 101. The superior sheeting 131 further comprises a first rouleau 161, a slit 162, and a collar 163. The slit 162 is further defined with a first raw edge 181 and a second raw edge 182. The first raw edge 181 is a raw edge formed by the slit 162 in the superior sheeting 131. The second raw edge 182 is a raw edge formed by the slit 162 in the superior sheeting 131.

The first rouleau 161 is a channel that is formed along the circumference of the superior sheeting 131. The first rouleau is sized such that the first split ring 132 can be inserted through the first rouleau 161 to stiffen the superior sheeting 131.

The slit 162 is a radial cut that is formed in the superior sheeting 131. The slit 162 runs from the circumference of the superior sheeting 131 to the collar 163 of the superior sheeting 131 such that the Christmas tree 201 inserts through the superior sheeting 131 into the collar 163.

The collar 163 is an opening that is concentrically formed in the circular structure of the superior sheeting 131. The collar 163 provides an opening that allows the bottom of the Christmas tree 201 to be surrounded by the superior sheeting 131. The collar 163 further comprises a collar 163 aperture 191 and a collar 163 gusset 192.

The collar 163 aperture 191 is a circular aperture that forms the opening formed by the collar 163 in the superior end 111. The collar 163 aperture 191 is coaxially positioned in the superior end 111. The collar 163 aperture 191 is sized such that the Christmas tree 201 will fit within the collar 163 aperture 191.

The collar 163 gusset 192 is a textile webbing. The collar 163 gusset 192 is sewn on the lateral sheeting 121 such that the collar 163 gusset 192 aligns with the circumference of the collar 163 aperture 191. The collar 163 gusset 192 reinforces the circumference of the collar 163 aperture 191 such that the circumference of the collar 163 aperture 191 will not fray during use.

The first split ring 132 is a circular ring shaped structure. The first split ring 132 is a semi-rigid structure with an elastic nature. The shape of the first split ring 132 is geometrically similar to the circumference of the superior sheeting 131 such that the first split ring 132 forms a structure that stiffens the superior sheeting 131. The first split ring 132 is cut such that two ends are formed. The two ends of the first split ring 132 are separable such that: a) the Christmas tree 201 inserts into the interior of the first split ring 132; and, b) the first split ring 132 attaches to the superior sheeting 131 by inserting the first split ring 132 through the first rouleau 161 of the superior sheeting 131. The inferior end 112 refers to a circular end of the hollow cylindrical structure that forms the containment structure 101.

The inferior end 112 is the end of the containment structure 101 that rests on the supporting surface when the containment structure 101 is removed from the Christmas tree 201 to form the tree skirt 203. The inferior end 112 is distal from the superior end 111 of the containment structure 101. The inferior end 112 comprises an inferior sheeting 141 and a second split ring 142.

The inferior sheeting 141 is formed from a textile. The inferior sheeting 141 has a circular shape. The diameter of the inferior sheeting 141 is identical to the diameter of the superior sheeting 131. The inferior sheeting 141 forms the surface of the inferior end 112 of the cylindrical structure of the containment structure 101. The inferior sheeting 141 further comprises a second rouleau 171. The second rouleau 171 is a channel that is formed along the circumference of the inferior sheeting 141. The second rouleau 171 is sized such that the second split ring 142 can be inserted through the second rouleau 171 to stiffen the inferior sheeting 141.

The second split ring 142 is a circular ring shaped structure. The diameter of the second split ring 142 is identical to the diameter of the first split ring 132. The second split ring 142 is a semi-rigid structure with an elastic nature. The shape of the second split ring 142 is geometrically similar to the circumference of the inferior sheeting 141 such that the second split ring 142 forms a structure that stiffens the inferior sheeting 141. The second split ring 142 is cut such that two ends are formed. The two ends of the second split ring 142 are separable such that the second split ring 142 attaches to the inferior sheeting 141 by inserting the second split ring 142 through the second rouleau 171 of the inferior sheeting 141.

The lateral face 113 forms a single continuous face of the containment structure 101 that attaches the superior end 111 to the inferior end 112. The lateral face 113 forms the vertical sides of the containment structure 101 as the containment structure 101 is removed from the Christmas tree 201 to form the tree skirt 203. The lateral face 113 comprises a lateral sheeting 121. The lateral sheeting 121 is further defined with a superior edge 152, an inferior edge 153, and a third raw edge 183, and a fourth raw edge 184.

The lateral sheeting 121 is formed from a textile. The lateral sheeting 121 has a rectangular shape. The lateral sheeting 121 attaches to the superior end 111 and the inferior end 112 such that the lateral sheeting 121 forms the lateral face 113 of the containment structure 101. The lateral sheeting further comprises a first handle 123 and a second handle 124. The first handle 123 is a textile webbing. The first handle 123 attaches to the exterior surface formed by the lateral sheeting 121 such that the first handle 123 forms a grip used to carry the invention 100. The second handle 124 is a textile webbing. The second handle 124 attaches to the exterior surface formed by the lateral sheeting 121 such that the second handle 124 forms a grip used to carry the invention 100.

The superior edge 152 is the edge of the lateral sheeting 121 that attaches the lateral sheeting 121 to the superior end 111. The superior edge 152 attaches to the first rouleau 161 of the superior sheeting 131 using a sewn seam.

The superior edge 152 attaches to the first rouleau 161 of the superior sheeting 131 such that the third raw edge 183 of the lateral sheeting 121 aligns with a first end selected from the two ends formed by the cut in the first split ring 132. The superior edge 152 attaches to the first rouleau 161 of the lateral sheeting 121 such that the third raw edge 183 of the lateral sheeting 121 aligns with the first raw edge 181 of the superior sheeting 131.

The superior edge 152 attaches to the first rouleau 161 of the superior sheeting 131 such that the fourth raw edge 184 of the lateral sheeting 121 aligns with a second end selected from the two ends formed by the cut in the first split ring 132. The superior edge 152 attaches to the first rouleau 161 of the lateral sheeting 121 such that the fourth raw edge 184 of the lateral sheeting 121 aligns with the second raw edge 182 of the superior sheeting 131.

The inferior edge 153 is the edge of the lateral sheeting that attaches the lateral sheeting 121 to the inferior end 112. The inferior edge 153 attaches to the second rouleau 171 of the inferior sheeting 141 using a sewn seam. The inferior edge 153 attaches to the second rouleau 171 of the inferior sheeting 141 such that the third raw edge 183 of the lateral sheeting 121 aligns with a third end selected from the two ends formed by the cut in the second split ring 142. The inferior edge 153 attaches to the second rouleau 171 of the inferior sheeting 141 such that the fourth raw edge 184 of the lateral sheeting 121 aligns with a fourth end selected from the two ends formed by the cut in the second split ring 142.

The third raw edge 183 forms an edge of the lateral face 113 that runs from the superior end 111 to the inferior end 112. The third raw edge 183 aligns with the first raw edge 181 such that the zipper 103 attaches the third raw edge 183 to the first raw edge 181 to form a first single edge of the zipper 103. The fourth raw edge 184 forms an edge of the lateral face 113 that runs from the superior end 111 to the inferior end 112. The fourth raw edge 184 aligns with the second raw edge 182 such that the zipper 103 attaches the fourth raw edge 184 to the second raw edge 182 to form a second single edge of the zipper 103.

In an embodiment of the disclosure, each of the plurality of storage compartments 102 is a chamber formed within the containment structure 101. The plurality of storage compartments 102 are used to store decorative items 202 associated with the Christmas tree 201. The plurality of storage compartments 102 comprises a plurality of compartmenting sheets 122. It shall be noted that the plurality of storage compartments 102 may be removable components, which are not formed within the containment structure 101.

The plurality of compartmenting sheets 122 forms the plurality of storage spaces contained within the containment structure 101. The plurality of compartmenting sheets 122 is a collection of textile sheeting that: a) attach to the lateral sheeting 121; and, b) interconnect with each other such that the plurality of compartmenting sheets 122 forms the plurality of storage compartments 102 in the containment structure 101. The plurality of compartmenting sheets 122 comprises a master sheeting 211 and a plurality of compartment sheets 212.

The master sheeting 211 is a rectangular sheeting. The master sheeting 211 attaches to the superior end 111 using a sewn seam. The master sheeting 211 further attaches to the lateral face 113 using a sewn seam. The master sheeting 211 attaches to the superior end 111 and the lateral face 113 such that an enclosed space is formed between the master sheeting 211 and the lateral face 113. The enclosed space created by the master sheeting 211 is accessed at the zipper 103.

Each of the plurality of compartment sheets 212 is a rectangular sheeting. The plurality of compartment sheets 212 forms a segregated space within the enclosed space created by the master sheeting 211. Sewn seams attaches each of the plurality of compartment sheets 212 to both the master sheeting 211 and the lateral face 113 such that each of the plurality of compartment sheets 212 forms a supporting structure intended to receive decorative items 202.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Chamber: As used in this disclosure, a chamber is a space that is dedicated to a purpose.

Channel: As used in this disclosure, a channel is a tubular passage through which an object or fluid is passed through.

Collar: As used in this disclosure, a collar is a ring like device that secures an object in a position.

Coaxial: As used in this disclosure, coaxial is an term that refers to a first object that is inserted or contained within a second object such: 1) that the first object and the second object share the same center point if the or first object and the second object are treated as a two-dimensional objects; or, 2) that the first object and the second object share the same center axis if the or first object and the second object are treated as a prism. Coaxial objects are often referred to as concentric.

Correspond: As used in this disclosure, the term correspond is used as a comparison between two or more objects wherein one or more properties shared by the two or more objects match, agree, or align within acceptable manufacturing tolerances.

Cylinder: As used in this disclosure, a cylinder is a geometric structure defined by two identical flat and parallel ends, also commonly referred to as bases, which are circular in shape and connected with a single curved surface, referred to in this disclosure as the lateral face. The cross section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends. See Truss Decorative: As used in this disclosure, decorative is an adjective that refers to a first object or item used with a second object or item of the purpose of making the second object or item more attractive. Decorative will generally, but not necessarily, implies making the second object or item more attractive visually.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Disposable: As used in this disclosure, disposable is an adjective that refers to an object that is designed and intended for a single use. Within this context, an object would be considered disposable if it is not reusable after its initial use.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Fastener: As used in this disclosure, a fastener is a device that is used to join or affix two objects. Fasteners generally comprise a first element which is attached to the first object and a second element which is attached to the second object such that the first element and the second element join to removably attach the first object and the second object. Common fasteners include, but are not limited to, hooks, zippers, magnets, snaps, buttons, buckles, quick release buckles, or hook and loop fasteners.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. Always use Correspond and One to One Grip: As used in this disclosure, a grip is an accommodation formed on or within an object that allows the object to be grasped or manipulated by a hand.

Gusset: As used in this disclosure, a gusset is a second textile that attaches to a first textile such that the second textile reinforces the ability of the first textile to handle forces otherwise borne by the first textile.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity.

Loop: As used in this disclosure, a loop is the length of a first linear structure including, but not limited to, shafts, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook inserts through the space formed within the first linear structure. Within this disclosure, the first linear structure is said to loop around the second linear structure.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Perimeter: As used in this disclosure, a perimeter is one or more curved or straight lines that bounds an enclosed area on a plane or surface. The perimeter of a circle is commonly referred to as a circumference.

Compartment: As used in this disclosure, a compartment is a small pouch or storage space formed into an object. Compartments are often formed by joining a second textile or a second sheeting to a first textile or a first sheeting, respectively, by sewing or heat sealing respectively. Methods to form compartments are well-known and documented in the textile and apparel arts.

Radial: As used in this disclosure, the term radial refers to a direction that: 1) is perpendicular to an identified central axis; or, 2) projects away from a center point.

Raw Edges: As used in this disclosure, a raw edge refers to one of two edges formed when a textile is cut through the face of the fabric. The ends of the slit are called the termination points.

Ring: As used in this disclosure, a ring is term that is used to describe a flat or plate like structure through which an aperture is formed. Rings are often considered loops.

Rouleau: As used in this disclosure, a rouleau is a tube or channel formed on the edge of a textile or sheeting.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheeting: As used in this disclosure, a sheeting is a material, such as a textile, a plastic, or a metal foil, in the form of a thin flexible layer or layers.

Slit: As used in this disclosure, a slit is a long narrow cut or opening formed in or through an object.

Superior: As used in this disclosure, the term superior refers to a directional reference that is parallel to and in the opposite direction of the force of gravity when an object is positioned or used normally.

Textile: As used in this disclosure, a textile is a material that is woven, knitted, braided or felted. Synonyms in common usage for this definition include fabric and cloth.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects.

Zipper: As used in this disclosure, a zipper is a fastening device comprising two flexible strips with interlocking components that are opened and closed by pulling a slide along the two flexible strips.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A storage apparatus comprising:

a containment structure, a plurality of storage compartments and a zipper;

wherein the plurality of storage compartments are formed in the containment structure;

wherein the containment structure is a hollow structure;

wherein the plurality of storage compartments are formed in the containment structure;

wherein the zipper is a fastening device;

wherein the zipper controls access into the hollow interior of the containment structure;

wherein the storage apparatus is configured for use with a Christmas tree;

wherein the storage apparatus is configured for use as a tree skirt;

wherein the storage apparatus is configured for use as a containment structure that stores the Christmas tree;

wherein the Christmas tree is stored within the hollow interior of the containment structure;

wherein the containment structure is a hollow cylindrical structure that is configured to be sized to receive the Christmas tree;

wherein the containment structure collapses when the Christmas tree is removed from the containment structure;

wherein the containment structure collapses such that the containment structure forms the tree skirt;

wherein the containment structure comprises a superior end, an inferior end, and a lateral face;

wherein the superior end is a circular end of the hollow cylindrical structure that forms the containment structure;

wherein the inferior end is a circular end of the hollow cylindrical structure that forms the containment structure;

wherein the superior end is distal from the inferior end of the containment structure;

wherein the superior end comprises a superior sheeting and a first split ring;

wherein the superior sheeting is formed from a textile with a circular shape;

wherein the superior sheeting forms the surface of the superior end of the cylindrical structure of the containment structure;

wherein the inferior end comprises an inferior sheeting and a second split ring;

wherein the inferior sheeting is formed from a textile with a circular shape;

wherein the diameter of the inferior sheeting is identical to the diameter of the superior sheeting;

wherein the inferior sheeting forms the surface of the inferior end of the cylindrical structure of the containment structure;

wherein the lateral face comprises a single continuous face of the containment structure that attaches the superior end to the inferior end;

wherein the lateral face forms the vertical sides of the containment structure;

wherein the lateral face comprises a lateral sheeting;

wherein the lateral sheeting is further defined with a superior edge, an inferior edge, and a third raw edge, and a fourth raw edge;

wherein the superior sheeting further comprises a first rouleau, a slit, and a collar;

wherein the first rouleau is a channel that is formed along the circumference of the superior sheeting;

wherein the slit is a radial cut that is formed in the superior sheeting;

wherein the slit is further defined with a first raw edge and a second raw edge;

wherein the collar is an opening that is concentrically formed in the circular structure of the superior sheeting;

wherein the inferior sheeting further comprises a second rouleau;

wherein the second rouleau is a channel that is formed along the circumference of the inferior sheeting.

2. The storage apparatus according to claim 1 wherein the first rouleau is a channel formed in the superior sheeting;

wherein the slit runs from the circumference of the superior sheeting to the collar of the superior sheeting;

wherein the collar provides an opening that receives the Christmas tree.

3. The storage apparatus according to claim 2 wherein the first split ring is a circular ring shaped structure;

wherein the first split ring is a semi-rigid structure with an elastic nature;

wherein the shape of the first split ring is geometrically similar to the circumference of the superior sheeting;

wherein the second split ring is a circular ring shaped structure;

wherein the second split ring is a semi-rigid structure with an elastic nature;

wherein the shape of the second split ring is geometrically similar to the circumference of the inferior sheeting;

wherein the diameter of the second split ring is identical to the diameter of the first split ring.

4. The storage apparatus according to claim 3 wherein the first split ring is cut such that two ends are formed;

wherein the two ends of the first split ring are separable;

wherein the second split ring is cut such that two ends are formed;

wherein the two ends of the second split ring are separable.

5. The storage apparatus according to claim 4 wherein the first rouleau attaches the first split ring to the superior sheeting by inserting the first split ring through the first rouleau of the superior sheeting;

wherein the second rouleau attaches the second split ring to the inferior sheeting by inserting the second split ring through the second rouleau of the inferior sheeting.

6. The storage apparatus according to claim 5 wherein the collar further comprises a collar aperture and a collar gusset;

wherein the collar aperture is a circular aperture;

wherein the collar gusset is a textile webbing;

wherein the collar gusset is sewn on the lateral sheeting such that the collar gusset aligns with the circumference of the collar aperture.

7. The storage apparatus according to claim 6 wherein the collar aperture is coaxially positioned in the superior end;

wherein the collar aperture is sized such that the Christmas tree will fit within the collar aperture.

8. The storage apparatus according to claim 7 wherein the lateral sheeting is formed from a textile;

wherein the lateral sheeting has a rectangular shape;

wherein the lateral sheeting attaches to the superior end and the inferior end such that the lateral sheeting forms the lateral face of the containment structure.

9. The storage apparatus according to claim 8 wherein the superior edge of the lateral sheeting attaches to the first rouleau of the superior sheeting using a sewn seam;

wherein the inferior edge attaches of the lateral sheeting to the second rouleau of the inferior sheeting using a sewn seam.

10. The storage apparatus according to claim 9 wherein the superior edge attaches to the first rouleau of the superior sheeting such that the third raw edge of the lateral sheeting aligns with a first end selected from the two ends formed by the cut in the first split ring;

wherein the superior edge attaches to the first rouleau of the superior sheeting such that the fourth raw edge of the lateral sheeting aligns with a second end selected from the two ends formed by the cut in the first split ring;

wherein the inferior edge attaches to the second rouleau of the inferior sheeting such that the third raw edge of the lateral sheeting aligns with a third end selected from the two ends formed by the cut in the second split ring;

wherein the inferior edge attaches to the second rouleau of the inferior sheeting such that the fourth raw edge of the lateral sheeting aligns with a fourth end selected from the two ends formed by the cut in the second split ring.

11. The storage apparatus according to claim 10 wherein the superior edge attaches to the first rouleau of the lateral sheeting such that the third raw edge of the lateral sheeting aligns with the first raw edge of the superior sheeting;

wherein the superior edge attaches to the first rouleau of the lateral sheeting such that the fourth raw edge of the lateral sheeting aligns with the second raw edge of the superior sheeting.

12. The storage apparatus according to claim 11 wherein the third raw edge forms an edge of the lateral face that runs from the superior end to the inferior end;

wherein the fourth raw edge forms an edge of the lateral face that runs from the superior end to the inferior end;

wherein the third raw edge aligns with the first raw edge such that the zipper attaches the third raw edge to the first raw edge to form a first single edge of the zipper;

wherein the fourth raw edge aligns with the second raw edge such that the zipper attaches the fourth raw edge to the second raw edge to form a second single edge of the zipper.

13. The storage apparatus according to claim 12 wherein the plurality of storage compartments comprises a plurality of compartmenting sheets;

wherein the plurality of compartmenting sheets is a collection of textile sheeting that: a) attach to the lateral sheeting; and, b) interconnect with each other such that the plurality of compartmenting sheets forms the plurality of storage compartments in the containment structure.

14. The storage apparatus according to claim 13 wherein the plurality of compartmenting sheets comprises a master sheeting and a plurality of compartment sheets;

wherein the master sheeting attaches to the superior end using a sewn seam;

wherein the master sheeting further attaches to the lateral face using a sewn seam;

wherein the master sheeting attaches to the superior end and the lateral face such that an enclosed space is formed between the master sheeting and the lateral face;

wherein the enclosed space created by the master sheeting is accessed at the zipper;

wherein the master sheeting is a rectangular sheeting;

wherein each of the plurality of compartment sheets is a rectangular sheeting;

wherein sewn seams attaches each of the plurality of compartment sheets to both the master sheeting and the lateral face.

15. The storage apparatus according to claim 14 wherein the lateral sheeting further comprises a first handle and a second handle;

wherein the first handle is a textile webbing;

wherein the first handle attaches to the exterior surface formed by the lateral sheeting such that the first handle forms a grip;

wherein the second handle is a textile webbing; wherein the second handle attaches to the exterior surface formed by the lateral sheeting such that the second handle forms a grip.

* * * * *